US007722360B2

(12) United States Patent
Millard et al.

(10) Patent No.: US 7,722,360 B2
(45) Date of Patent: May 25, 2010

(54) ELECTRICAL CONNECTOR WITH REDUCED NOISE

(75) Inventors: Steven Jay Millard, Mechanicsburg, PA (US); Juli Susan Olenick, Lake Worth, FL (US)

(73) Assignee: Tyco Electronics Corporation, Middletown, PA (US)

( * ) Notice: Subject to any disclaimer, the term of this patent is extended or adjusted under 35 U.S.C. 154(b) by 139 days.

(21) Appl. No.: 11/899,504

(22) Filed: Sep. 6, 2007

(65) Prior Publication Data

US 2009/0068889 A1 Mar. 12, 2009

(51) Int. Cl.
*H01R 12/00* (2006.01)

(52) U.S. Cl. ..... 439/66; 439/91; 439/607.05

(58) Field of Classification Search ..... 439/66, 439/91, 67, 607, 71, 607.01, 607.05, 862
See application file for complete search history.

(56) References Cited

U.S. PATENT DOCUMENTS

| | | | | |
|---|---|---|---|---|
| 5,248,262 | A * | 9/1993 | Busacco et al. | 439/66 |
| 6,106,305 | A * | 8/2000 | Kozel et al. | 439/66 |
| 6,264,476 | B1 * | 7/2001 | Li et al. | 439/66 |
| 6,790,057 | B2 * | 9/2004 | DelPrete et al. | 439/91 |
| 7,070,420 | B1 * | 7/2006 | Wakefield et al. | 439/66 |
| 7,448,877 | B1 * | 11/2008 | Pennypacker et al. | 439/66 |
| 7,448,883 | B2 * | 11/2008 | Alden et al. | 439/91 |

* cited by examiner

*Primary Examiner*—Xuong M Chung-Trans

(57) ABSTRACT

An electrical connector includes a carrier having opposite first and second sides. A plurality of contacts are held in the carrier. Each contact includes a first conductive element and a second conductive element. The first conductive element defines a conductive path configured to electrically connect an electrical component on the first side of the carrier to an electrical component on the second side of the carrier. The second conductive element provides an electrostatic shield for the first conductive element.

17 Claims, 6 Drawing Sheets

ELECTRICAL CONNECTOR WITH REDUCED NOISE

BACKGROUND OF THE INVENTION

The invention relates generally to surface mounted connectors, and more specifically, to a connector that reduces the crosstalk added to signals passing through the connector.

The trend toward smaller, lighter, and higher performance electrical components and higher density electrical circuits led to the development of surface mount technology in the design of electrical systems. As is well understood in the art, surface mount packaging allows an electronic package to be attached to pads on the surface of a circuit board, either directly or through a surface mount connector, rather than by means of contacts or pins positioned in plated holes in the circuit board. Surface mount technology allows for an increased component density on a circuit board, thereby saving space on the circuit board.

In a connector, with the close proximity of contacts to one another there is a potential for crosstalk and the loss of signal integrity. As signal speeds have increased, crosstalk has become a serious issue. Some circuit boards that carry high speed signals incorporate transmission lines in the board design wherein the width of signal traces and the distance between signal and ground traces are controlled to reduce crosstalk. High speed signals propagate down a transmission line considerably better than down a stand alone trace. However, when the signal encounters a connector, the transmission line is disturbed. Typically, the benefits derived from the transmission line are not maintained as the signal moves through the connector.

A need exists for a connector that preserves signal integrity through the connector by reducing crosstalk in the connector.

BRIEF DESCRIPTION OF THE INVENTION

In one embodiment, an electrical connector is provided. The connector includes a carrier having opposite first and second sides. A plurality of contacts are held in the carrier. Each contact includes a first conductive element and a second conductive element. The first conductive element defines a conductive path configured to electrically connect an electrical component on the first side of the carrier to an electrical component on the second side of the carrier. The second conductive element provides an electrostatic shield for the first conductive element.

Optionally, each contact includes an insulative layer having opposite inner and outer sides and wherein one of the conductive elements is formed on the outer side and the other of the conductive elements is formed on the inner side. A plurality of polymer columns are held by the carrier. Each polymer column includes a first end extending from the first side of the carrier and a second end extending from the second side of the carrier. Each contact includes an elongated contact body extending along a longitudinal axis between opposite contact ends. The body includes bends proximate the contact ends that are configured to position the contact ends proximate the first and second ends of one of the polymer columns. The polymer columns are configured to define the mechanical properties of the connector. The carrier includes a plurality of slots and each contact is mounted in one of the slots. A portion of each contact is configured to move within the slot when the contact is compressed.

In another embodiment, a contact for an electrical connector is provided that includes a flexible layer of insulative material having opposite inner and outer sides. The flexible layer includes a body that extends along a longitudinal axis between opposite first and second contact ends. A first conductive element is on the outer side of the flexible layer and extends between the first and second contact ends. A second conductive element is on the inner side of the flexible layer and extends along the body. The second conductive element provides an electrostatic shield for the first conductive element.

DETAILED DESCRIPTION OF THE INVENTION

Figure 1:
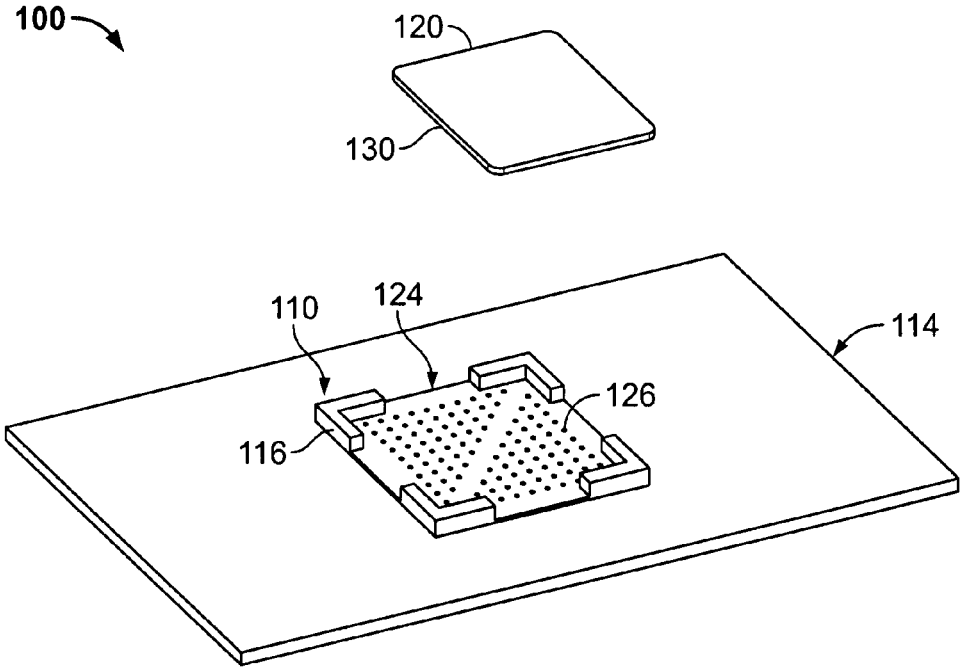
FIG. 1 is an exploded view of an electronic assembly including a connector formed in accordance with an exemplary embodiment of the present invention.

FIG. 1 illustrates an electronic assembly 100 including a connector 110 formed in accordance with an exemplary embodiment of the present invention. The connector 110 is mounted on a circuit board 114 and an electronic package 120 is loaded onto the connector 110. When loaded onto the connector 110, the electronic package 120 is electrically connected to the circuit board 114. In one embodiment, the connector 110 may be a socket connector. The electronic package 120 may be a chip or module such as, but not limited to, a central processing unit (CPU), microprocessor, or an application specific integrated circuit (ASIC), or the like.

The connector 110 includes a dielectric housing 116 that is configured to be mounted on the circuit board 114. The housing 116 holds an interconnect member 124 that includes a plurality of electrical contact assemblies 126. The electronic package 120 has a mating surface 130 that engages the interconnect member 124. The interconnect member 124 is interposed between contact pads (not shown) on the mating surface 130 of the electronic package 120 and corresponding contact pads (not shown) on the circuit board 114 to provide electrical paths to electrically connect the electronic package 120 to the circuit board 114 as will be described. It is to be understood, however, that such description is for illustrative purposes only and that no limitation is intended thereby. That is, the interconnect member 124, in other embodiments, may be used to interconnect two electrical components such as two circuit boards or two electronic packages. Further, although the interconnect member 124 is described with reference to a purely compressive interconnect member, it is to be understood that the interconnect member 124 may also be used in applications where other connection methods, such as solder connections on one or both sides of the interconnect member 124, are employed.

Figure 2:
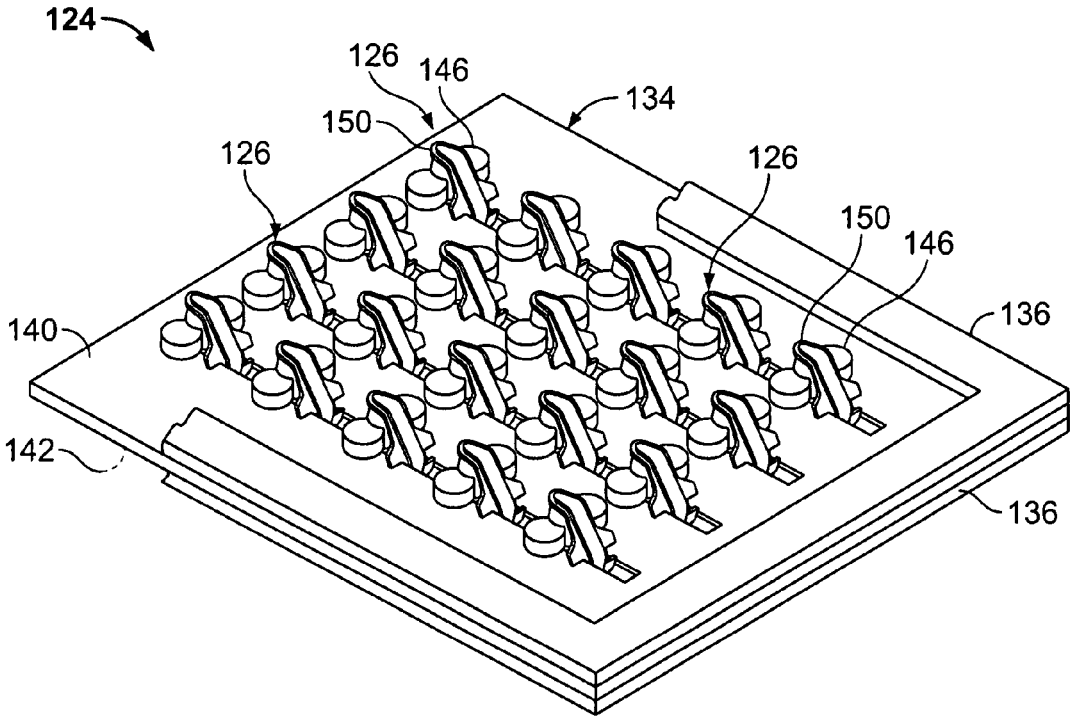
FIG. 2 is an enlarged view of a portion of an interconnect member formed in accordance with an exemplary embodiment of the present invention.

FIG. 2 illustrates an enlarged perspective view of a portion of the interconnect member 124 which is formed in accordance with an exemplary embodiment of the present invention. The interconnect member 124 includes a carrier 134 upon which the contact assemblies 126 are arranged. In one embodiment, the contact assemblies 126 are arranged on opposite sides of a diagonal (not shown) that divides the contact assemblies 126 into two contact groups. The contact assemblies 126 on opposite sides of the diagonal face each other to neutralize frictional forces on the electronic package 120 (FIG. 1) that result from the compression of the contact assemblies 126 that would otherwise tend to push the electronic package 120 toward one corner of the connector 110 (FIG. 1). In some embodiments, the carrier 134 is positioned between compression stops 136. In such embodiments, the compression stops 136 are provided to limit the compression of the contact assemblies 126 when the electronic package 120 is loaded into the connector 110.

The carrier 134 has a first side 140 and an opposite second side 142. Each contact assembly 126 includes a polymer column 146 and a contact 150, both of which are held in the carrier 134. The polymer columns 146 and contacts 150 are positioned to align with contact pads (not shown) on the electronic package 120 (FIG. 1) and the circuit board 114 (FIG. 1).

Figure 3:
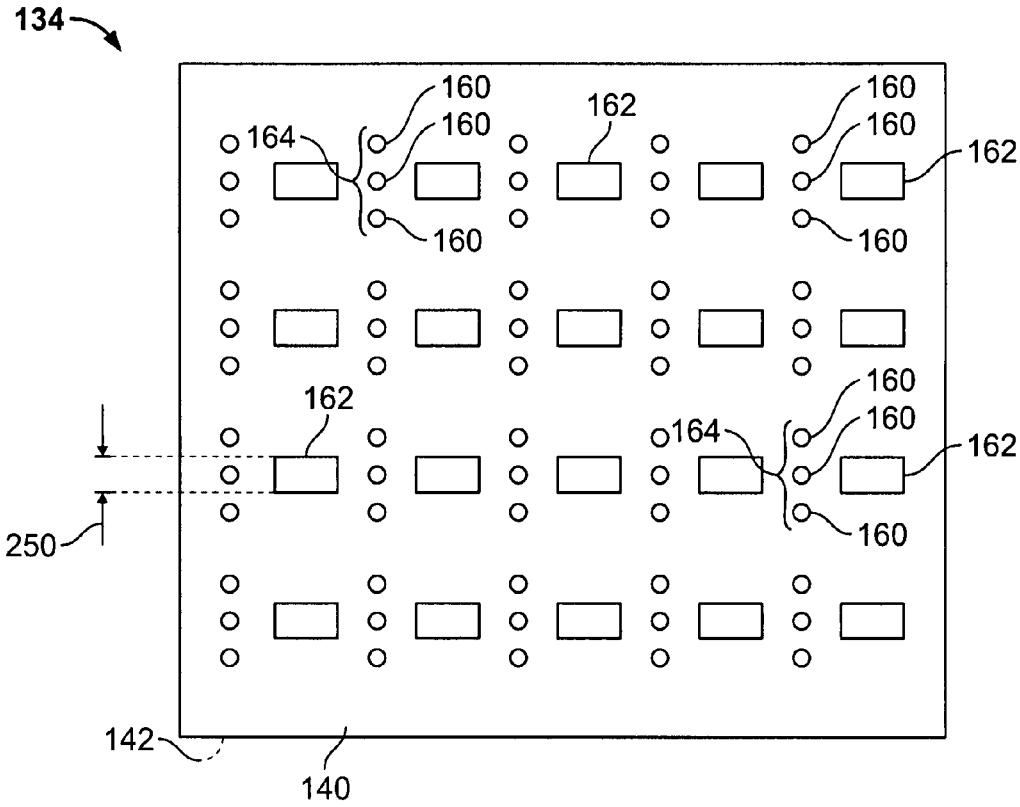
FIG. 3 is a top plan view of the carrier shown in FIG. 2.

FIG. 3 illustrates a top plan view of the carrier 134. The carrier 134 includes a plurality of apertures 160 and slots 162. The polymer columns 146 (FIG. 2) may be molded onto the carrier 134 at the apertures 160. In the illustrated embodiment, the apertures 160 are arranged in groups 164 that include three of the apertures 160, with each group 164 defining a location of one polymer column 146. It is to be understood however, that other arrangements of apertures 160 are possible including more or fewer apertures 160. For instance, the apertures 160 in each group 164 may be replaced by a single aperture sized to retain one polymer column 146. Further, the apertures 160 may take geometric shape other than the circular shapes shown. Each slot 162 has a transverse width 168 that is sized to receive a contact 150 as will be described. In an exemplary embodiment, the carrier 134 may be fabricated from stainless steel. In other embodiments, the carrier 134 may be fabricated from an insulative material such as a polyimide or FR4, which is commonly used for circuit boards.

Figure 4:
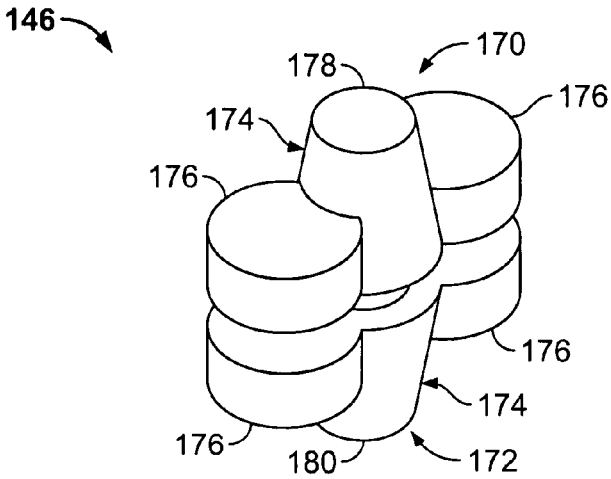
FIG. 4 is a perspective view of a polymer column shown in FIG. 2.

FIG. 4 illustrates a perspective view of the polymer column 146. Each polymer column 146 includes a first end 170 and an opposite second end 172. When installed in the carrier 134 (FIG. 3), the first end 170 extends from the first side 140 of the carrier 134 and the second end 172 extends from the second side 142 of the carrier 134. The polymer column 146 includes a primary column 174 and may also include one or more secondary support columns 176. The secondary support columns 176, when present, are provided to stabilize and control the direction of compression of the primary column 174. The primary column 174 includes a first engagement end 178 that extends from the first side 140 of the carrier 134 and a second engagement end 180 that extends from the second side 142 of the carrier 134. The polymer columns 146 provide the desired mechanical properties including normal force and working range for the contact assemblies 126. The polymer columns 146 may be formed from either a pure polymer or a mixed polymer selected to provide desired mechanical properties. In an exemplary embodiment, the polymer columns 146 may be molded directly onto the carrier 134.

Figure 5:
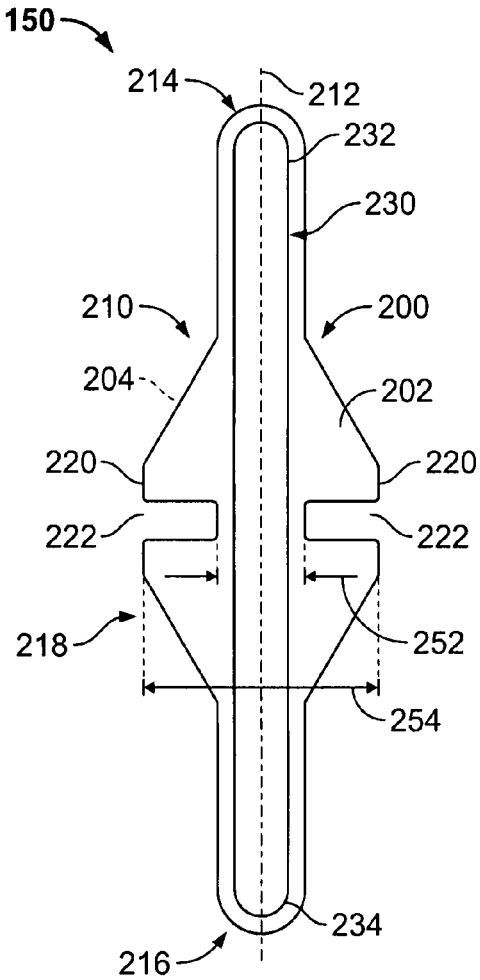
FIG. 5 is an enlarged top plan view of a contact shown in FIG. 2 in a flat state.
Figure 6:
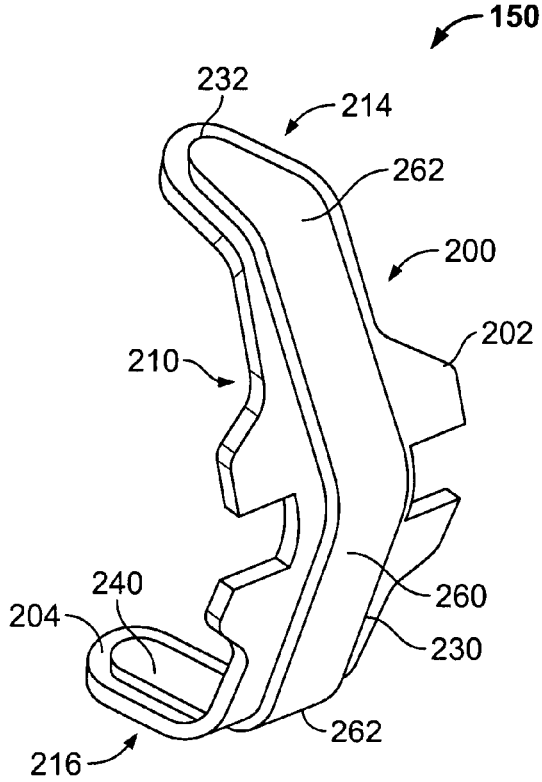
FIG. 6 is a perspective view of the contact shown in FIG. 5 in a formed condition.

FIG. 5 illustrates an enlarged top plan view of a contact 150 in a flat state. FIG. 6 illustrates a perspective view of the contact 150 in a formed condition as shown in FIG. 2. The contact 150 includes a layer of a flexible insulative material 200 such as a polyimide material that includes a front or outer side 202 and an opposite back or inner side 204. The contact 150 includes a body 210 that extends along a longitudinal axis 212 between opposite contact ends 214 and 216. The contact body 210 includes a centrally located mounting portion 218 that includes wings 220 with notches 222. When installed in the carrier 134 (FIG. 3), the wings 220 are configured to frictionally engage the carrier 134 while allowing some degree of movement between the contact body 210 and the carrier 134. A first conductive element 230 is formed on the outer side 202 of the flexible layer 200 and includes contact tips 232 and 234. A second conductive element 240 is formed on the inner side 204 of the flexible layer 200. In an exemplary embodiment, the flexible layer 200 is fabricated from a flexible polyimide material. One such polyimide material is commonly known as Kapton® which is available from E. I. du Pont de Nemours and Company. The conductive elements 230 and 240 may be formed from copper that may be etched or otherwise adhered to the flexible layer 200. After application of the conductive elements 230 and 240 to the flexible layer 200, the contacts 150 are formed to their final shape as shown in FIG. 6.

With renewed reference to FIG. 3, each slot 162 in the carrier 134 is configured to hold a contact 150. Each slot 162 has a transverse width 250 that is sized to receive a transverse width 252 of the contact body 210 at the notches 222 while the wings 220 have a transverse width 254 that is greater than the width 250 of the slot 162. When installed in the carrier 134, the notches 222 of the contact body 210 fit within the slot 162 while the wings 220 engage the first and second sides 140 and 142, respectively, of the carrier 134 so that the conductive elements 230 and 240 are isolated from the carrier 134.

The contact 150 is formed such that the contact body 210 includes a centrally located bend 260 that facilitates flexing of the contact body 210 when interposed and compressed between two electrical components such as the electronic package 120 (FIG. 1) and the circuit board 114 (FIG. 1). The contact body 210 includes bends 262 at each contact end 214 and 216. When the contact 150 is installed in the carrier 134, the contact body 210 extends through the carrier 134. The contact 150 is positioned and dimensioned such that the contact tips 232 and 234 are proximate the engagement ends 178 and 180 of one of the polymer columns 146 and oriented for accurate registration with the contact pads (not shown in FIG. 4) on the circuit board 114 and the electronic package 120.

The first conductive element 230 defines a conductive path that electrically connects a first electrical component such as the electronic package 120 on the first side 140 of the carrier 134 to a second electrical component such as the circuit board 114 on the second side 142 of the carrier 134. In an exemplary embodiment, the second conductive element 240 does not establish a conductive path between electrical components. More specifically, the second conductive element 240 is generally not current carrying. Rather, the second conductive element 240 is held at ground potential and acts as a ground. On each contact 150, the second conductive element 240 is much closer to the first conductive element 230 than any adjacent contact 150, such that when the first conductive element 230 is signal carrying, the second conductive element 240 electromagnetically couples with the first conductive element 230 and acts as an electrostatic shield. The electrostatic shielding provided by the second conductive element 240 reduces electromagnetic coupling between neighboring contacts 150 to thereby reduce the crosstalk that occurs between neighboring contacts 150 in the connector 110.

Figure 7:
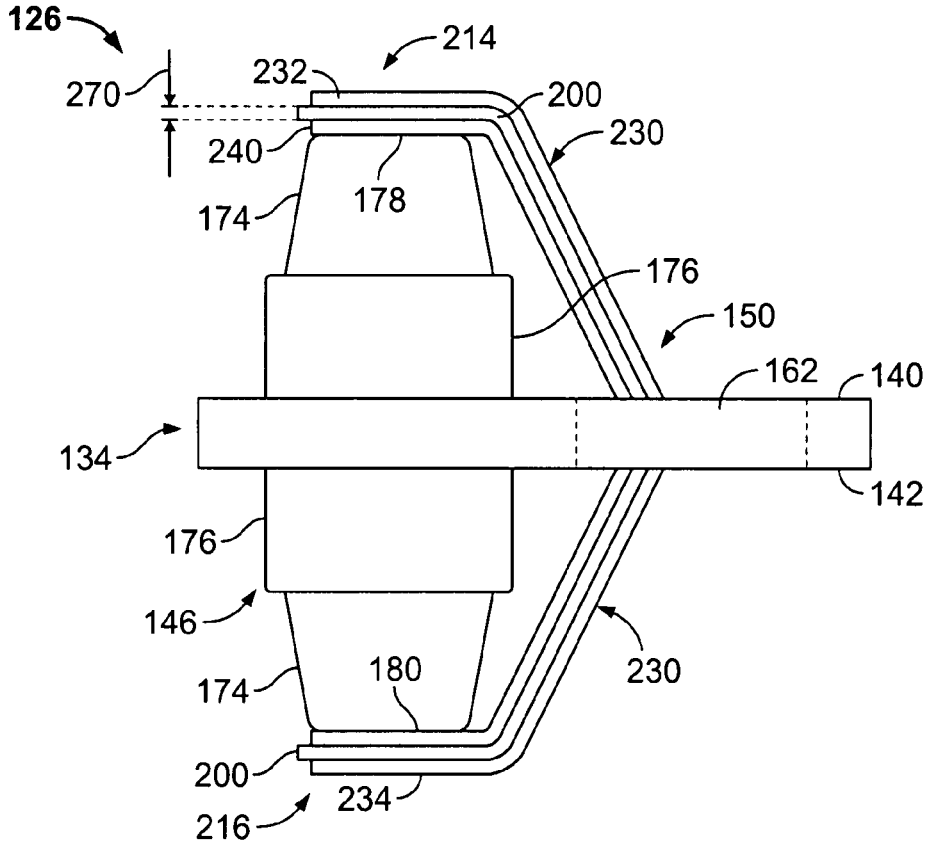
FIG. 7 is an enlarged side view of a contact assembly in an uncompressed state.
Figure 8:
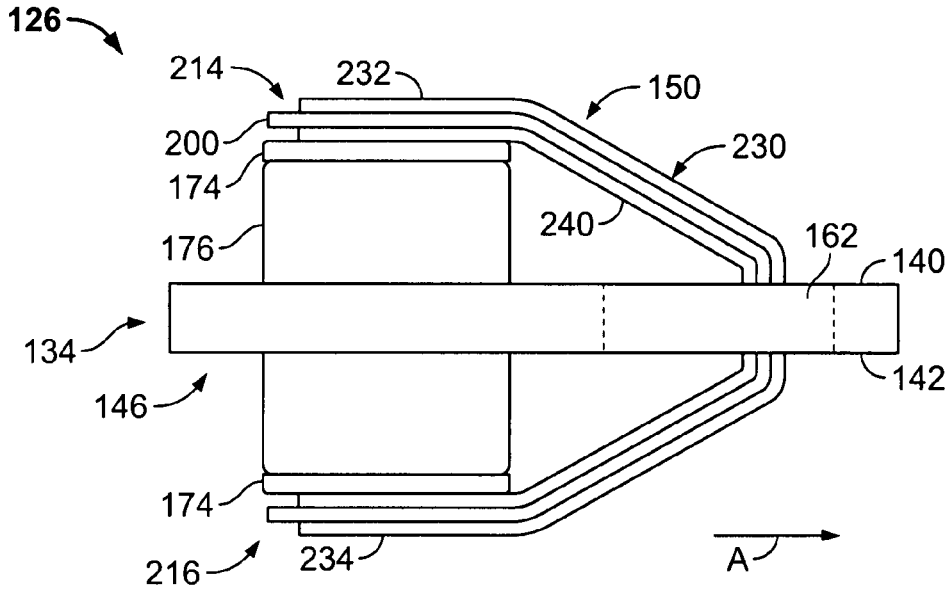
FIG. 8 is an enlarged side view of a contact assembly in a compressed state.

FIG. 7 illustrates an enlarged side view of the contact assembly 126 in an uncompressed state. FIG. 8 illustrates an enlarged side view of the contact assembly 126 in a compressed state. When the contacts 150 are loaded into the carrier 134, the slots 162 in the carrier 134 provide clearance space for flexing of the contacts 150. The wings 220 frictionally engage the first and second sides 140 and 142 respectively of the carrier 134 sufficiently to prevent the contact ends 214 and 216 from becoming disengaged from the polymer columns 146 while permitting the contact body 210 to move in the direction of the arrow A within the slot 162 to flex in response to a compressive load on the contact assembly 126. Coincident with the flexing of the contact 150, the polymer column 146, and particularly the primary column 174, is compressed in response to the compressive load on the contact assembly 126.

The flexible layer 200 of the contact 150 has a thickness 270 which represents a distance between the first conductive element 230 and the second conductive element 240. At such distances, when the first conductive elements 230 are signal carrying and the second conductive element 240 is at ground, and more particularly, a non-current carrying ground, the signal and ground are tightly electromagnetically coupled to one another rather than the signal being coupled to a signal carried in an adjacent contact 150. That is, the second conductive element 240 electrostatically shields the signal carried in the first conductive element 230 such that crosstalk introduced in the connector 110 is reduced even at high contact densities. In this manner, degradation of signal integrity through the connector 110 is minimized. In FIGS. 7 and 8, the second conductive element 240 is shown as extending to the engagement ends 178, 180 of the primary polymer column 174. However, in other embodiments, the second conductive element 240 need not extend to the engagement ends 178, 180 of the primary polymer column 174.

Figure 9:
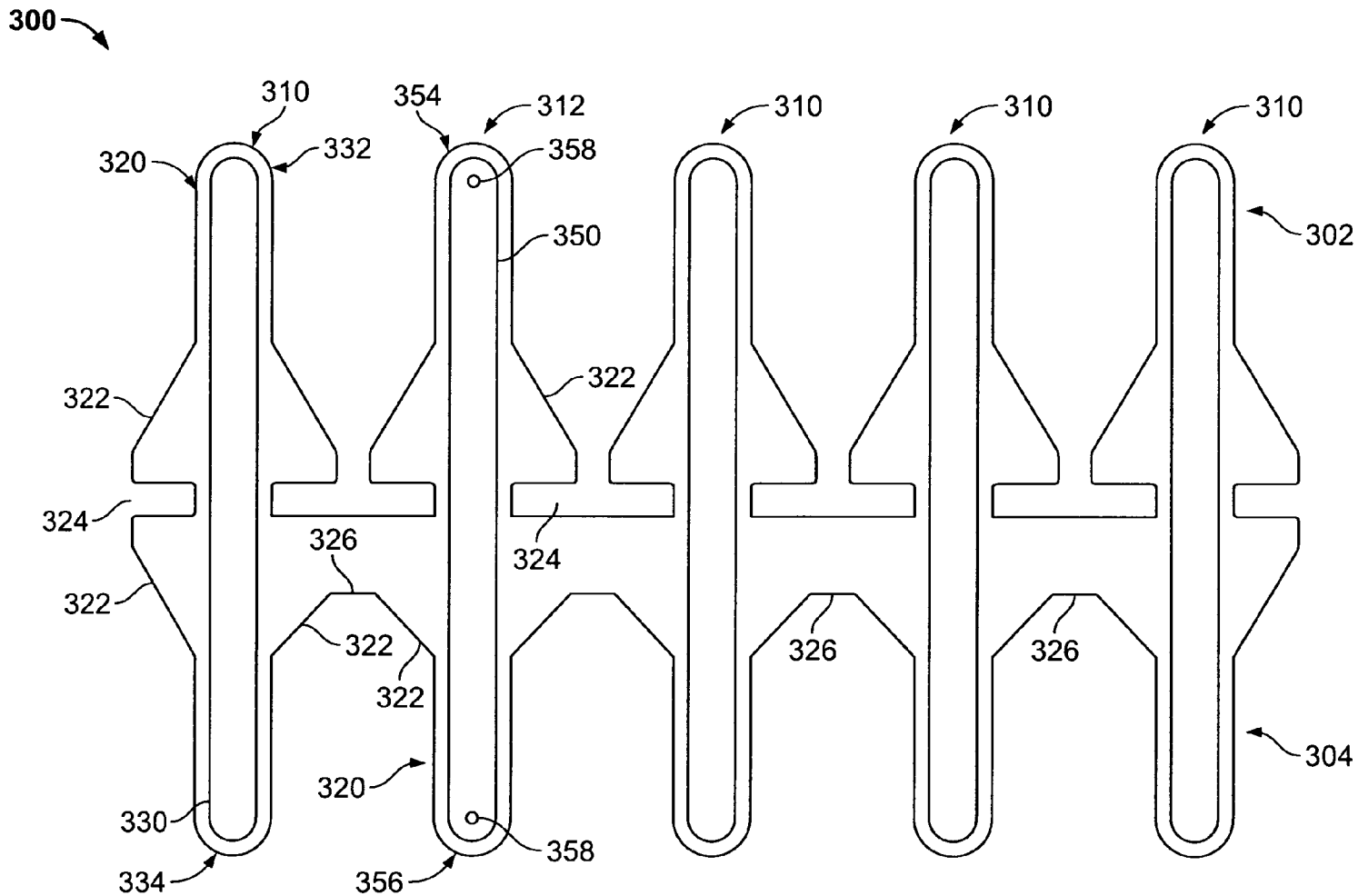
FIG. 9 is an enlarged plan view of the front or outer side of an interconnected row of contacts shown in a flat state.
Figure 10:
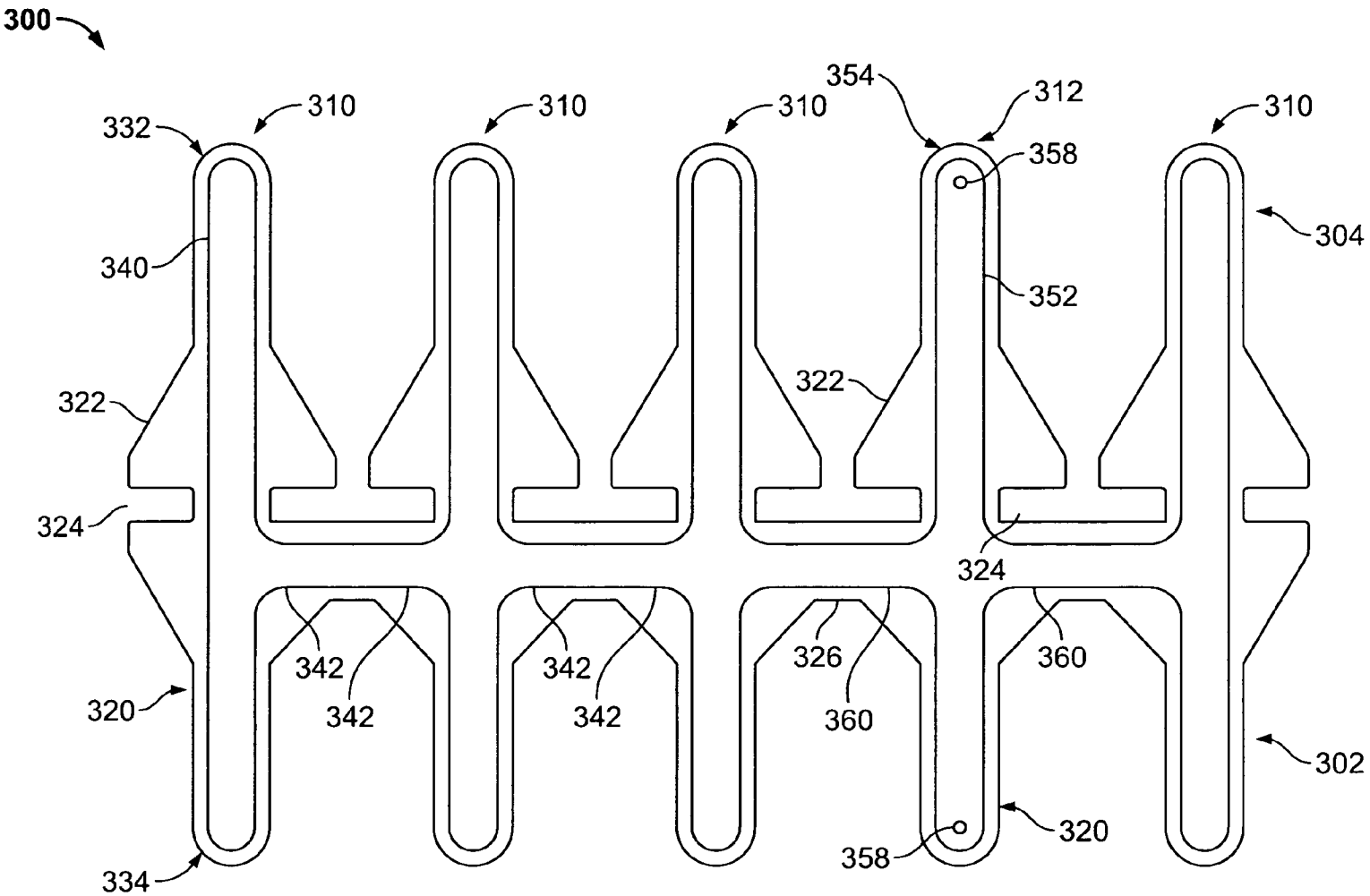
FIG. 10 is an enlarged plan view of the back or inner side of the contact row shown in FIG. 9.

FIG. 9 illustrates an enlarged plan view of a contact row 300 shown in a flat state and taken from a front or outer side 302. FIG. 10 illustrates an enlarged plan view of a back or inner side 304 of the contact row 300. The contact row comprises a number of interconnected contacts 310 and 312. Each contact 310, 312 includes a flexible layer 320 that has wings 322 with notches 324 as previously described with respect to the contact 150 (FIG. 5). The wings 322 of each contact 310, 312 are joined to the wings 322 of adjacent contacts 310, 312 by an interconnecting portion 326 to interconnect the contacts 310, 312 and form the contact row 300. The interconnections between the contacts 310, 312 are all on the same side of the notches 324 which facilitates loading of the contact row 300 onto the carrier 134 (FIG. 3) as a unit.

Each contact 310 includes a first conductive element 330 formed on the outer side 302 of the contact row 300 that extends between opposite contact ends 332 and 334 of the contact 310. The first conductive element 330 is identical to the first conductive element 230 (FIG. 5) previously described. Each contact 310 also includes a second conductive element 340 on the inner side 304 of the contact row 300. The second conductive element 340 includes lateral extensions 342 that extend along the inner side of the interconnecting portions 326 of the flexible layer 320 to electrically connect the second conductive element 340 of each contact 310 to the second conductive element 340 of an adjacent contact 310 or 312 in the contact row 300. As previously described, on each contact 310, the second conductive element 340 is at ground potential and electromagnetically couples with the first conductive element 330 to provide an electrostatic shield for the first conductive element 330, thereby reducing crosstalk between neighboring contacts 310.

Each contact 312 includes a first conductive element 350 formed on the outer side of the contact row 300 and a second conductive element 352 formed on the inner side of the contact row 300. The first conductive element 350 extends between contact ends 354 and 356 and is identical to the first conductive element 330 on the contact 310 with the exception that the first conductive element 350 may include one or more vias 358 that also extend at least through the flexible layer 320 to enable the establishment of electrical connectivity with the second conductive element 352. Although the via 358 is shown as extending through the first and second conductive elements 350 and 352, it is to be understood that the via 358 may be formed only in the flexible layer 320 and connectivity between the first and second conductive elements 350 and 352 may be established by such means as plating the via or filling the via with a conductive material.

The second conductive element 352 includes lateral extensions 360 that extend along the inner side of the interconnecting portions 326 of the flexible layer 320 to interconnect the second conductive element 352 with the second conductive elements of the contacts 310 or additional contacts 312, as described above with respect to the lateral extension 342 of the contact 310. After the conductive elements 350 and 352 are applied to the flexible layer 320, the contacts 310 and 312 are formed to their final shape which is similar to that of the contact 150 as shown in FIG. 6.

As illustrated in FIGS. 9 and 10, the contact row 300 includes one of the contacts 312, however, in other embodiments, more or no contacts 312 may be present. With regard to the contact 312, the second conductive element 352 is shown as extending between the contact ends 354 and 356, and is configured to rest upon the engagement ends 178 and 180 of one of the primary polymer columns 174 when loaded into the carrier 134. However, in other embodiments, the second conductive element 352 need not extend to the engagement ends 178, 180 of the primary polymer column 174.

When the second conductive element 352 does not extend to the engagement ends 178 and 180, a via may be placed elsewhere along the first and second conductive elements 350 and 352 respectively, or at least in the flexible layer 320 between the first and second conductive elements 350 and 352 to provide for the establishment of an electrical connection between the first and second conductive elements 350 and 352. In some embodiments, the second conductive element 352 may be configured to engage the carrier 134 when the carrier 134 is fabricated from a conductive material such as stainless steel. To reiterate, this is done only for the contacts 312. Further, it is to be understood, that by electrically interconnecting the first and second conductive elements 350 and 352 to one another, the contact 312 is a dedicated ground contact that is configured to interconnect dedicated ground circuits (not shown) on the electronic package 120 (FIG. 1) and the circuit board 114 (FIG. 1), or more generally on each of two electronic components (not shown).

The embodiments thus described provide a connector 110 that preserves signal integrity through the connector 110 by reducing crosstalk introduced in the connector 110. The connector 110 includes a contact 150 having at least two separate conductive elements 230, 240 formed on opposite sides of a flexible layer 200. The conductive element 240 on the inner side 204 of the flexible layer 200 provides electrostatic shielding for the conductive element 230 on the outer side 202 of the flexible layer 200 to thereby reduce crosstalk in the connector 110. Alternatively, the contacts are formed in a contact row 300 including contacts 310 formed on interconnected flexible layers 320. The conductive elements 340 on the inner side 304 of the flexible layers 320 are interconnected and provide shielding. The contact row 300 may also include a dedicated ground contact 312 having first and second conductive elements 350 and 352 that are electrically connected through a via 358.

While the invention has been described in terms of various specific embodiments, those skilled in the art will recognize that the invention can be practiced with modification within the spirit and scope of the claims.

What is claimed is:

1. An electrical connector comprising:

a carrier having opposite first and second sides with a slot extending through the carrier from the first side to the second side; and a contact held in the slot of the carrier, the contact including an insulative layer extending between opposite contact ends of the contact, the contact including first and second conductive elements on opposite surfaces of the insulative layer, the first conductive element providing a conductive path for electrically coupling an electrical component proximate the first side of the carrier with an electrical component proximate the second side of the carrier, the second conductive element providing an electrostatic shield for the first conductive element, wherein the contact includes a centrally disposed mounting portion that engages the carrier to hold the contact in the slot, further wherein the mounting portion is configured to move within the slot when the contact is compressed between the electrical components, wherein the mounting portion includes wings that engage said first and second sides of said carrier when said contact is loaded into said carrier.

2. The electrical connector of claim 1, further comprising a polymer column held by said carrier, the polymer column including a first end extending from said first side of said carrier and a second end extending from said second side of said carrier.

3. The electrical connector of claim 2, wherein the contact includes an elongated contact body extending along a longitudinal axis between said contact ends, said body including bends proximate said contact ends that are configured to position said contact ends proximate said first and second ends of the polymer column.

4. The electrical connector of claim 2, wherein the polymer column includes a primary column and a secondary column supporting said primary column, said primary and secondary columns radially overlapping one another.

5. The electrical connector of claim 1, wherein the mounting portion is configured to move in a direction parallel to the first and second sides of the carrier within said slot when said contact is compressed.

6. The electrical connector of claim 1, wherein the mounting portion includes notches, said contact body having a transverse width at said notches that is less than a transverse width of the contact body at the wings, the transverse width at said notches configured to be received within said slot.

7. The electrical connector of claim 1, wherein the first side of the carrier extends along a plane and the mounting portion of the contact moves along the plane when the contact engages the electrical components.

8. The electrical connector of claim 1, wherein the contact ends move toward one another in opposing directions and the mounting portion moves in a transverse direction when the contact engages the electrical components.

9. The electrical connector of claim 1, further comprising a plurality of the contacts arranged in a row, wherein the insulative layers of the contacts are joined to one another.

10. An electrical connector comprising:

a carrier having opposite first and second sides with a slot extending through the carrier from the first side to the second side; and a contact held in the slot of the carrier, the contact including first and second conductive elements on opposite surfaces of the contact for electrically coupling electronic components proximate the first and second sides of the carrier, the contact comprising a centrally disposed mounting portion that engages the first and second sides of the carrier proximate the slot to retain the contact in the carrier while permitting movement of the contact within the slot, wherein the mounting portion includes laterally protruding wings that engage the first and second sides of the carrier.

11. The contact of claim 10, wherein said contact is configured to be a dedicated ground contact with said first and second conductive elements electrically connected to one another.

12. The contact of claim 10, wherein the contact comprises a flexible insulative layer disposed between the first and second conductive elements, wherein said first and second conductive elements are separated by a distance corresponding to a thickness of said flexible insulative layer.

13. The electrical connector of claim 10, wherein the first conductive element is configured to communicate a signal between the electronic components and the second conductive element provides an electrostatic shield for the first conductive element.

14. The electrical connector of claim 10, wherein said contact extends along a longitudinal axis between opposite contact ends with the mounting portion centrally located between the contact ends.

15. The electrical connector of claim 10, wherein the first side of the carrier extends along a plane and the mounting portion of the contact moves along the plane when the contact engages the electrical components.

16. The electrical connector of claim 10, wherein the mounting portion includes a notch disposed in the slot of the carrier, the mounting portion extending along a transverse width of the contact that is greater than a width of the slot along the first and second sides of the carrier, wherein a transverse width of the mounting portion proximate to the notch is less than the width of the slot.

17. The electrical connector of claim 10, wherein the contact ends move toward one another in opposing directions and the mounting portion moves in a transverse direction when the contact engages the electrical components.

* * * * *